United States Patent [19]

Catteau

[11] 3,938,269

[45] Feb. 17, 1976

[54] CASE FOR DISPLAYING NOTICES

[76] Inventor: Jean Catteau, 10, rue de Mora, Enghien-les-Bains (Val d'Oise), France

[22] Filed: Apr. 1, 1974

[21] Appl. No.: 457,135

Related U.S. Application Data

[63] Continuation-in-part of Ser. No. 247,631, April 26, 1972, abandoned.

[30] Foreign Application Priority Data

Apr. 30, 1971 France ..... 71.15505

[52] U.S. Cl. ..... 40/30; 40/82; 40/125 H

[51] Int. Cl.[2] ..... G09F 11/00

[58] Field of Search ..... 40/30, 33, 82–85, 40/125 K, 125 H; 100/23 R, 120

[56] References Cited

UNITED STATES PATENTS

| | | | |
|---|---|---|---|
| 625,615 | 5/1899 | Tubbs | 40/84 |
| 685,771 | 11/1901 | Langer | 40/84 |
| 800,036 | 9/1905 | Warren | 40/84 |
| 981,184 | 1/1911 | Fitch | 40/83 |
| 1,026,214 | 5/1912 | Koike | 40/84 |
| 1,621,407 | 3/1927 | Hill | 40/84 |
| 3,640,482 | 2/1972 | Von Hippel | 40/85 X |

FOREIGN PATENTS OR APPLICATIONS

| | | | |
|---|---|---|---|
| 671,166 | 8/1929 | France | 160/23 R |

*Primary Examiner*—John H. Wolff

*Attorney, Agent, or Firm*—Waters, Schwartz & Nissen

[57] ABSTRACT

A case for displaying notices, having a body including a translucent front face; appropriate, sealingly interconnected walls; the bottom wall having an access opening; a removable shutter for closing the opening; above the front face a drum, on which is mounted a rollable, flexible element adapted to pass through the opening; the flexible element being provided with means for attaching a notice, so that the latter is situated in an extension and beyond the rollable element; the drum being rotatable for winding and unwinding; and means for arresting the drum when the attaching means have passed beyond the bottom wall toward the outside, and when the same means have attained a height at which the notice is exposed through the translucent front face, so as to prevent the notice from being rolled up on the drum.

5 Claims, 3 Drawing Figures

CASE FOR DISPLAYING NOTICES

Figure 1:
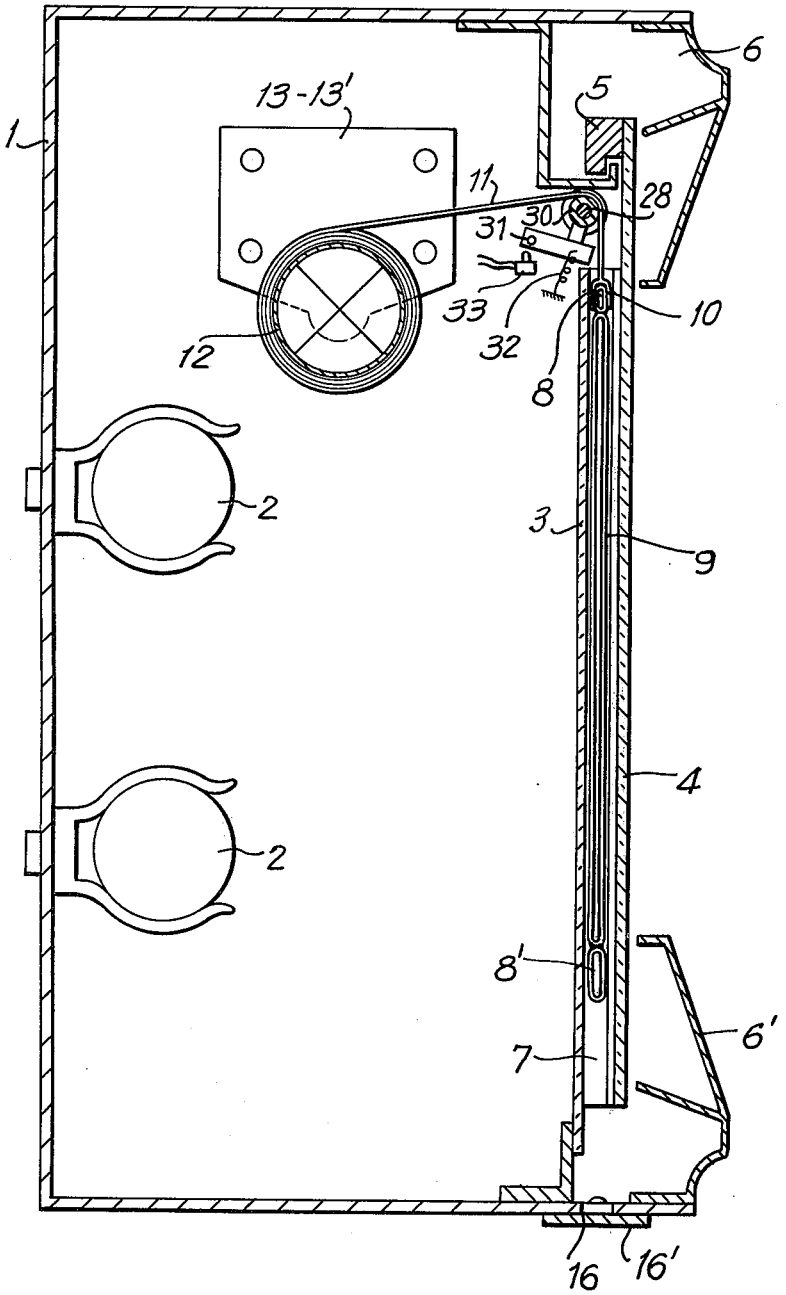

This is a continuation-in-part of applicant's earlier patent application Ser. No. 247,631, filed Apr. 26, 1972, titled "Display Case," now abandoned.

The present invention relates to a panel structure forming an illuminated display case for notices, posters or placards, lighted by transparence.

Illuminated display devices are known which use a case containing electric means which form a light source and of which the front face consists of two plates one being transparent to diffuse light uniformly to an illumined area, and the second or outer plate being of translucent material.

The notice or poster for display is inserted between the diffusing and the translucent plates; for that purpose the outer plate is made detachable or is articulated on a hinge so as to allow it to be opened as a window, and to give free access to the diffusing face onto which the notice or poster is fastened, for example, by means of adhesive tape.

Such devices are, however, far from satisfactory nor do they allow convenient and easy use.

Paper posters, generally of a fairly large size, are frangible and run the risk of tearing during insertion or showing unsightly creases, thus harming the requisite aesthetic effect of the display. Furthermore, the fastening of the poster remains a delicate matter since the latter must be arranged in a vertical position, held down with one hand while fastening it flat with colorless adhesive tape, running along the top edge of the poster, and adhering to the diffusing plate which acts as a support for the poster.

This movement is made difficult in devices where the outer wall is fastened and hinge-mounted, since the outer wall forming the show window being kept in place impedes free access to the top of the supporting wall and makes it difficult to change each poster. When the outer wall is taken out, changing the poster is easier but the taking-out and replacement of the show window represent additional work and a risk of breakage or wear and tear.

For all these reasons the replacement of each poster, which is fairly frequent operation, must be entrusted to departmental personnel having a modicum of experience, which entails a noteworthy operational overhead.

Moreover cases according to the prior art are not sealed and are poorly protected against intrusion of moisture and the risks of unsticking, condensation effects inside the case, and cockling of the poster.

In addition, cases are known which contain a drum on which the poster can be wound like a window shade so as to take two positions according to whether the poster is wound on the drum or unwound.

Such cases are described for example in U.S. Pat. Nos. 1,026,214, 1,621,407 and 3,640,482.

The illuminated display case according to the invention has as its object to remedy the various disadvantages mentioned above and to provide a display device for quick, simple changing of notices or posters, while at the same time offering improved working conditions as against previous similar products, and differing radically from the cases described in the above U.S. patents. While the case according to the invention does contain a drum, the poster, by reason of a totally different conception, does not have to be windable thereon.

Thus, the present invention relates to a case for displaying notices, forming a definitively positioned homogeneous whole, the window or outer glass whereof is not opened and remains permanently incorporated with the body of the case.

Insertion is effected through a lower slot or access opening allowing access to a space between two walls, the poster or notice being joined onto some windable components previously brought into a bottom position, then wound upward, thus bringing the poster into a suitable position behind the translucent wall and in front of a light-diffusing wall.

Clearly with the case according to the invention a changing of posters is obtained which is particularly simple and quick and no longer requires experienced and specially trained personnel since the emergence of the outcoming poster and the placing of the rising poster are automatic.

Finally, the device allows usage of plasticized posters, facilitating their better color reproduction and correct positioning.

This device allows the frequent changing of posters or notices, thus extending the field of use of illuminated cases to new domains. For example, the illuminated display case according to the invention lends itself to the display of movie programs requiring frequent changes and easy handling.

Figure 2:
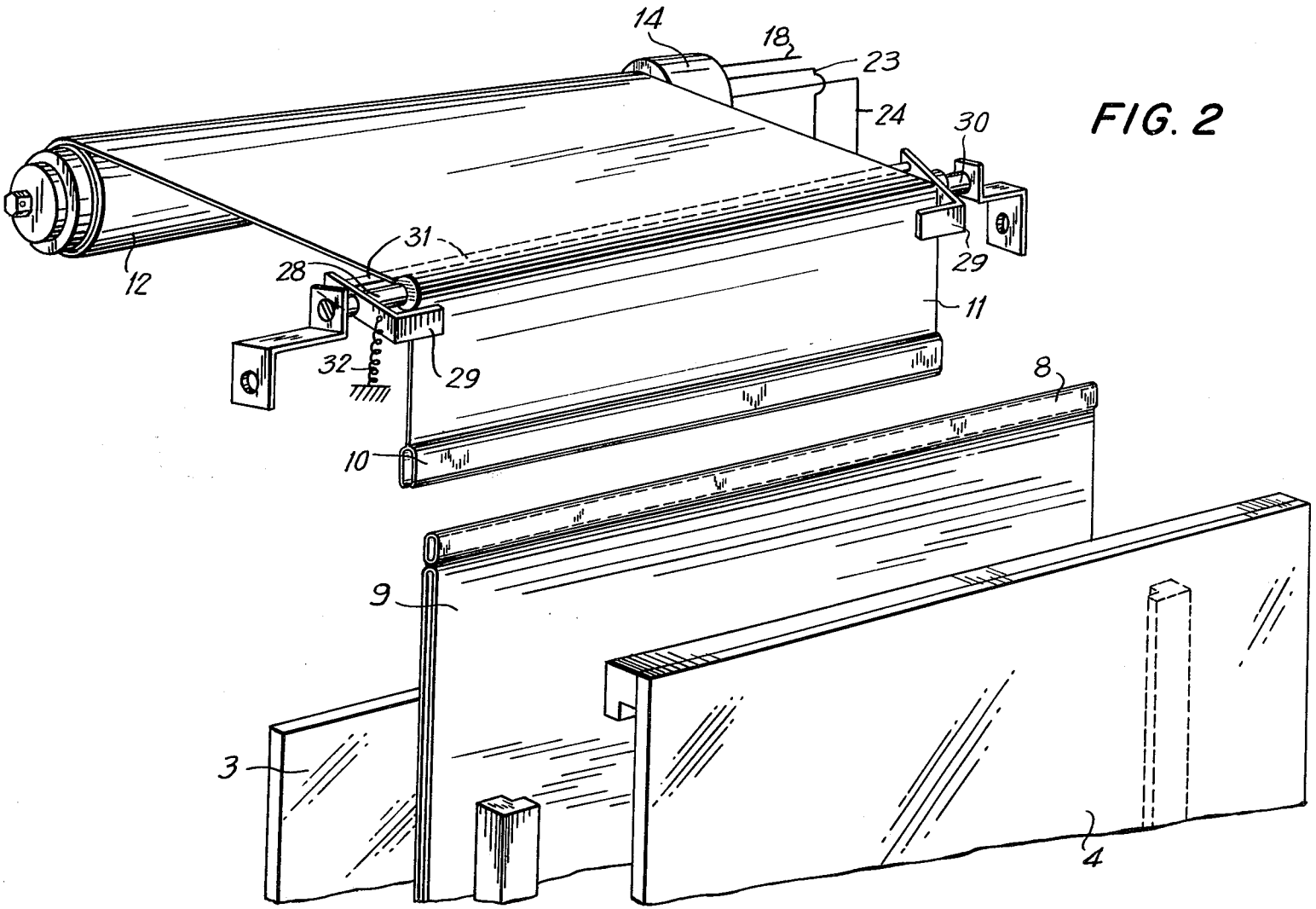
Figure 3:
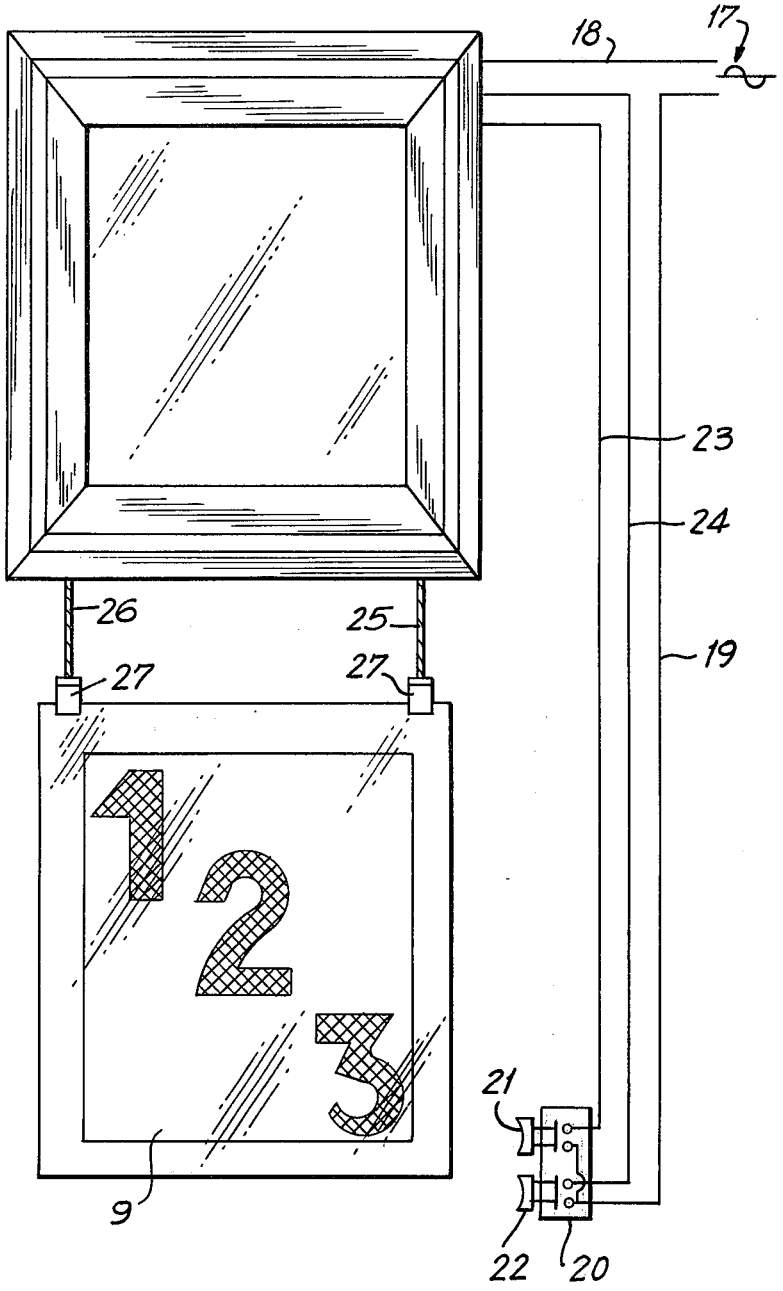

Other characteristics and advantages of the invention will be further evident from the following description which is given in relation to a preferred, exemplary embodiment of the invention, offered without limitation of character, with reference to the annexed drawings, wherein FIG. 1 is a horizontal sectional view of an exemplary embodiment of the inventive apparatus;

FIG. 2 is an exploded perspective view of a winding and driving device for a blind or flexible element carrying a notice; and FIG. 3 is a partial schematic view of the apparatus according to the invention, showing the notice in a lowered position.

Referring to FIG. 1, the case comprises a rear wall part or base 1 on which light sources are mounted, for example, in the form of fluorescent tubes 2, 2'; the front face is formed by a first lower wall part 3 of a transparent and frosted synthetic substance forming a diffusion surface for the light, for example, of methyl methacrylate; a second outer wall part 4 forming a show window protecting a notice or poster 9 and also made of colorless, translucent methyl methacrylate, this face being suspended by its top edge 5 so as to allow extension or distension of that face.

The outer face 4 is kept in place by a decorative angle-iron 6, 6' running around the face of the case and extending along the side and the upper box wall parts, thus ensuring the tightness of the case against entry of water from the outside.

A notice 9 is inserted in a space 7 separating the two front wall parts 3, 4; for this purpose, the upper end of notice 9 is joined by any suitable means to the lower or free edge 10 of a plasticized linen blind or flexible element 11 wound on a drum 12: the latter is suspended on angle brackets or squares 13, 13' and driven by an electric motor 14.

At the bottom of the case, access to the space 7 is obtained either through a slot or access opening 16 provided in the lower wall part of the case and closed by a small plate or shutter 16', or through an opening of the base by a rear articulation, the whole forming an opening flap. This arrangement, being within the scope of those skilled in the art, is not illustrated.

According to a preferred embodiment the notice is plasticized from a polyvinyl chloride tube adhering to its two faces while leaving an upper space allowing a rod 8 to be placed in the top portion of notice 9 and a small metal bar 8' as ballast at the bottom of notice 9, to facilitate its descent by gravity for removal of the emerging notice.

It is easy to clean regularly the space forming the housing or gap for the notice so as to keep the methyl methacrylate walls neat and perfectly transparent, by winding up by means of the motion of blind 11 as will be described further on, with a rag soaked with some cleaning compound which is applied to the surface or the surfaces to be cleansed.

The electric motor is supplied from a power source 17 (FIG. 3) by a direct conductor wire 18 and a conductor wire 19 leading to a switch 20 (FIG. 3) having two buttons or switches 21 and 22 corresponding respectively to an electrical connection between the conductor 19 and a conductor 23, or conductor 19 and a conductor 24, as shown in FIGS. 2 and 3.

The two buttons 21 and 22 are restored by springs, as is well known to men skilled in the art, so that contact may be made on pressing the button against the spring and broken as soon as the pressure is released.

On pressing button 21, the current travels through the conductor 23 and feeds the motor 14, making it revolve in the direction corresponding to the winding of blind 11 on drum 12, that is to say corresponding to the raising of notice 9. When button 22 is pressed, the current travels through conductor 24 and feeds the motor to make it run in the opposite direction, (opposite to the foregoing) corresponding to the unwinding of blind 11, namely to the descent of notice 9.

In FIGS. 1 and 2, notice 9 is shown in its top position, facing walls 3 and 4. In FIG. 3, notice 9 is shown in its lowered position, namely it is brought outside the case to a level for easy access near the switch 20.

Also, in the FIG. 3, a variant is shown whereby drum 12 takes not a flexible panel but two spaced links 25 and 26 such as chains, cables or wires according to the strength and/or flexibility required.

Each link 25, 26 is provided at its end with a clip 27 of any known type, whereby the notice 9 can be hung onto the links 25 and 26.

Thus, after notice 9 is fastened to lines 25 and 26 by clips 27, button 21 is pushed to institute the winding of the links on drum 12, driven by motor 14, until the notice 9 has fully entered into the case, is in the display position and under cover, facing the wall parts 3 and 4.

To prevent the notice 9 from inopportunely winding on to the drum, any known means of stoppage are provided.

In the embodiment illustrated (see FIG. 2) an idler roller 28 is provided to secure perfect verticality of notice or poster 9. The stop means can be provided in the vicinity of said roller 28 and can consist of one or two blades 29 mounted loose on the shaft 30 of roller 28 and coupled together by a bar 31 which is restrained by a spring 32 so that the blades 29 slope downward. They meet on the course of the edge 10 or clips 27 so that the blades are raised when those components are about to reach the roller 28. By this means the blades 29 tilt and break a contact 33 (see FIG. 1) located on one of the leads 18 or 23, thus stopping the motor power 14 and causing the winding to cease.

Conversely, to prevent drum 12 from unwinding the whole blind 11 or the whole of the links 25, 26 an overrunning switch can be located on drum 12, as is widely known.

These means of stoppage can, in any case, be effected by various methods, since it is within the capacity of men of the art to provide automatic stoppage of an electric motor when the drum it is driving reaches one or other of two preset extreme positions.

I claim:

1. A case for displaying notices, comprising, in combination:

a parallepipedal body of the type including bottom, rear, side and top wall parts and an at least translucent, non-removably mounted front face in a substantially vertical, opaque frame, constituting a front wall part; said wall parts being sealingly interconnected; said bottom wall part having therein a single access opening substantially below said front wall part, including a removable shutter and means for sealing the latter in a substantially water- and dust-proof manner when closed; said body including in its upper inner space and behind the upper edge of said front face at least one rotatable drum in substantially parallel alignment with said upper edge of the front face and with said access opening;

at least one flexible element haivng two ends, one by which said flexible element is removably attached to said drum along a generatrix of the latter, and another, free end, and having a length greater than a path that runs from the generatrix of said drum to said access opening, when said flexible element is passed from said drum about said upper edge of the front face and thence along the inside of the latter, substantially vertically down toward said access opening;

means for attaching at least one notice to said free end of the flexible element so that the notice is suspended as an extension of and lengthwise beyond said flexible element;

said access opening having a width and a length that allow at least the notice and said attaching means to pass therethrough by gravity, upon rotation of said drum in a first direction;

drive means for selectively rotating said drum in the first direction, which corresponds to the unwinding of said flexible element attached thereto, with said free end moving downward along said inside of the front face and toward said access opening, and in a second direction which corresponds to winding up said flexible element onto said drum; and means for arresting said drive means, on the one hand, when said attaching means have just passed beyond said bottom wall toward the outside through said access opening, the notice being then entirely on the outside; and, on the other hand, when said attaching means have attained a height just below said upper edge of the front face, the notice being then fully exposed through said translucent front face, said arresting means also constituting means for preventing the notice from ever reaching, and being rolled up even partly on, said drum.

2. The case as defined in claim 1, wherein said at least one flexible element is constituted by a pair of spaced-apart straps such as chains, cables, wires and the like.

3. The case as defined in claim 1, wherein said at least one flexible element is constituted by at least one soft panel.

4. The case as defined in claim 1, wherein said attaching means are constituted by at least two clips for connecting the at least one notice to said free end of the flexible element.

5. The case as defined in claim 1, further comprising a freely rotatable roller supported in the area just above said upper edge of the front face, said at least one flexible element being trained thereabout in the path that runs from said drum toward said access opening.

* * * * *